US008961217B2

(12) United States Patent
Dang

(10) Patent No.: US 8,961,217 B2
(45) Date of Patent: Feb. 24, 2015

(54) ELECTRICAL CONNECTOR ASSEMBLY WITH INTEGRATED LATCHING SYSTEM, STRAIN RELIEF, AND EMI SHIELDING

(71) Applicant: Carlisle Interconnect Technologies, Inc., Kent, WA (US)

(72) Inventor: Phong Dang, Auburn, WA (US)

(73) Assignee: Carlisle Interconnect Technologies, Inc., Kent, WA (US)

( * ) Notice: Subject to any disclaimer, the term of this patent is extended or adjusted under 35 U.S.C. 154(b) by 157 days.

(21) Appl. No.: 13/795,928

(22) Filed: Mar. 12, 2013

(65) Prior Publication Data

US 2014/0273585 A1 Sep. 18, 2014

(51) Int. Cl.
*H01R 13/627* (2006.01)
*H01R 13/648* (2006.01)
*H01R 13/58* (2006.01)

(52) U.S. Cl.
CPC ..... *H01R 13/58* (2013.01)
USPC ..... 439/358; 439/607.47

(58) Field of Classification Search
USPC ..... 439/358, 607.47, 607.48
See application file for complete search history.

(56) References Cited

U.S. PATENT DOCUMENTS

| | | | | |
|---|---|---|---|---|
| 4,337,989 | A * | 7/1982 | Asick et al. | 439/607.23 |
| 4,544,227 | A * | 10/1985 | Hirose | 439/607.28 |
| 4,653,836 | A * | 3/1987 | Peele | 439/607.47 |
| 4,702,542 | A * | 10/1987 | Noyes | 439/347 |
| 4,979,910 | A | 12/1990 | Revil et al. | |
| 5,017,149 | A | 5/1991 | Hatanaka | |
| 5,178,557 | A * | 1/1993 | Hashiguchi | 439/357 |
| 5,199,903 | A * | 4/1993 | Asick et al. | 439/607.47 |
| 5,213,533 | A | 5/1993 | Walden | |
| 5,387,130 | A | 2/1995 | Fedder et al. | |
| 5,486,117 | A | 1/1996 | Chang | |
| 5,564,935 | A | 10/1996 | Yagi et al. | |
| 5,660,558 | A * | 8/1997 | Osanai et al. | 439/353 |
| 5,797,771 | A | 8/1998 | Garside | |
| 5,836,774 | A | 11/1998 | Tan et al. | |
| 5,975,957 | A * | 11/1999 | Noda et al. | 439/607.19 |
| 6,056,578 | A | 5/2000 | Lin | |
| 6,328,588 | B1 * | 12/2001 | Tsai et al. | 439/352 |
| 6,558,183 | B1 | 5/2003 | Ji et al. | |
| 6,595,801 | B1 | 7/2003 | Leonard et al. | |
| 6,705,894 | B1 * | 3/2004 | Comerci et al. | 439/607.47 |
| 6,953,361 | B2 | 10/2005 | Li et al. | |
| 6,957,976 | B2 | 10/2005 | Zhang | |
| 7,621,770 | B1 | 11/2009 | Finizio et al. | |
| 7,967,642 | B2 | 6/2011 | Schoene et al. | |
| 8,011,948 | B2 | 9/2011 | Wu | |
| 8,298,002 | B2 | 10/2012 | Patel et al. | |
| 2006/0094281 | A1 | 5/2006 | Dang | |

FOREIGN PATENT DOCUMENTS

| | | | |
|---|---|---|---|
| EP | 0 907 221 | A2 | 4/1999 |

* cited by examiner

*Primary Examiner* — Neil Abrams
(74) *Attorney, Agent, or Firm* — Stoel Rives LLP

(57) ABSTRACT

An electrical connector includes an electrically conductive housing for inhibiting electromagnetic interference. A latch device is mounted to opposite sides of the housing and extends from the housing for positively latching together the electrical connector with a mating connector. The latch device includes a biasing member for driving a latching end of the latch device toward a catch of the mating connector to securely retain the connectors in a mated configuration. The housing further includes a skirt on a mating end, the skirt having a plurality of cantilevered tangs for bearing against a corresponding skirt of the mating connector.

12 Claims, 6 Drawing Sheets

ELECTRICAL CONNECTOR ASSEMBLY WITH INTEGRATED LATCHING SYSTEM, STRAIN RELIEF, AND EMI SHIELDING

TECHNICAL FIELD

The field of the present disclosure relates generally to electrical connectors, and in particular, to electrical connectors having a housing with EMI shielding properties and an integrated latching system and strain relief.

BACKGROUND

An electrical connector is a device used to join electrical circuits at an interface using a mechanical assembly. In some instances, the connection may be temporary, such as for portable equipment or cables, or serve as a permanent electrical joint between two wires or devices. There are numerous types and designs of electrical connectors to accommodate the widespread use of these devices.

Typically, electrical connectors include a connector housing for retaining and protecting connector bodies, such as plug connectors having pin contacts. Connector housings are typically formed from lightweight plastic materials and include a separate metal shield or foil insert surrounding the connector bodies to inhibit electromagnetic interference. In addition, electrical connectors typically include a forward-facing skirt to maintain a mated configuration with another mating connector and also provide additional protection for any protruding components of the electrical connectors, such as pin contacts.

Some electrical connectors further include a latching mechanism to help securely latch mated connectors to one another, or a connector to a chassis or panel. Such latching mechanisms typically include a number of assembly parts, such as lever arms, springs, pins, screws, or other fasteners, and require tools for assembly and disassembly.

The present inventor has recognized a need for a lightweight, compact, and inexpensive electrical connector with a reduced number of assembly parts and a streamlined design to facilitate manufacturing and repair processes. In addition, the present inventor has recognized a need for such an electrical connector with improved mating features to better retain a mated configuration with a mating connector.

Additional aspects and advantages will be apparent from the following detailed description of preferred embodiments, which proceeds with reference to the accompanying drawings.

DETAILED DESCRIPTION OF PREFERRED EMBODIMENTS

With reference to the drawings, this section describes particular embodiments and their detailed construction and operation. Throughout the specification, reference to "one embodiment," "an embodiment," or "some embodiments" means that a particular described feature, structure, or characteristic may be included in at least one embodiment. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Figure 1:
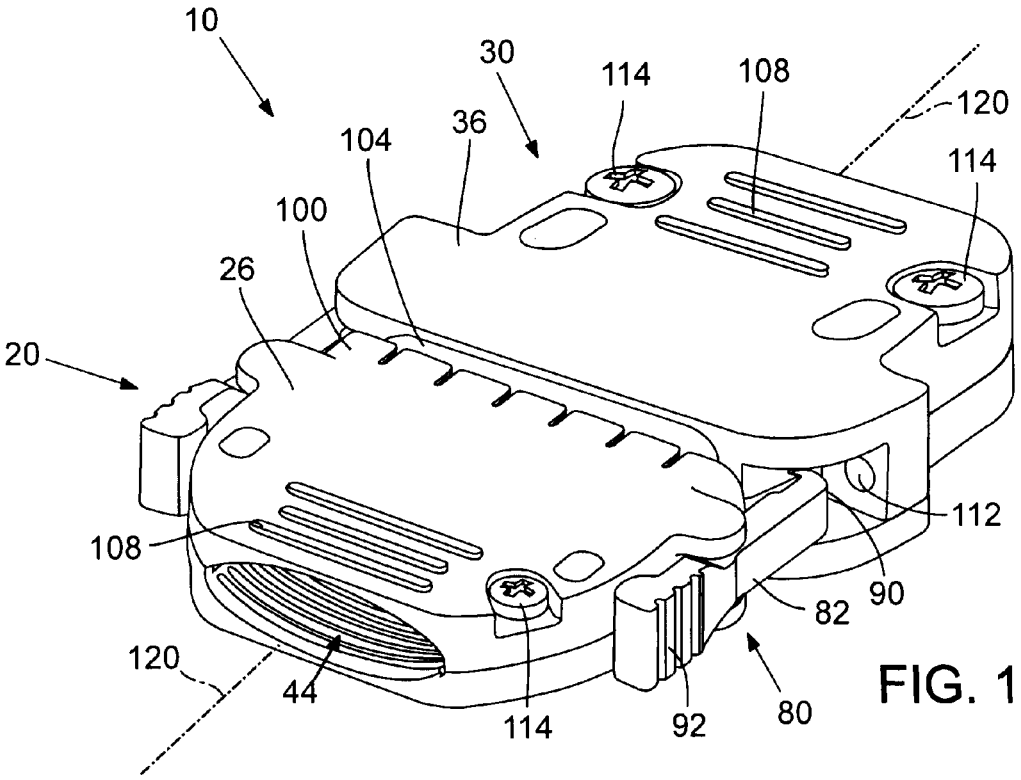
FIG. 1 is a perspective view of an electrical connector assembly with corresponding plug and socket connector assemblies, shown without electrical cables terminated by the connector assemblies.
Figure 2:
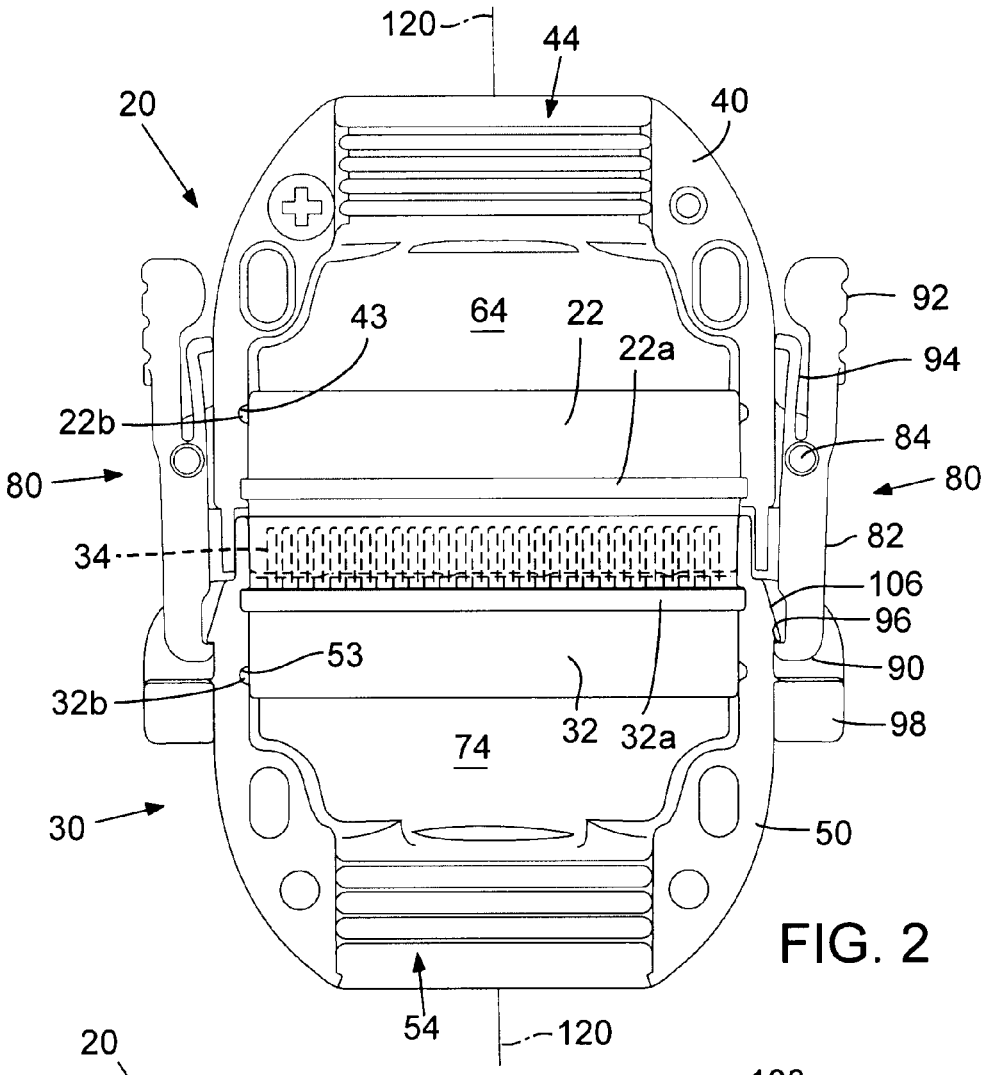
FIG. 2 is a plan view of the electrical connector assembly of FIG. 1 with a top housing section removed to show detail of the mated connectors.
Figure 7:
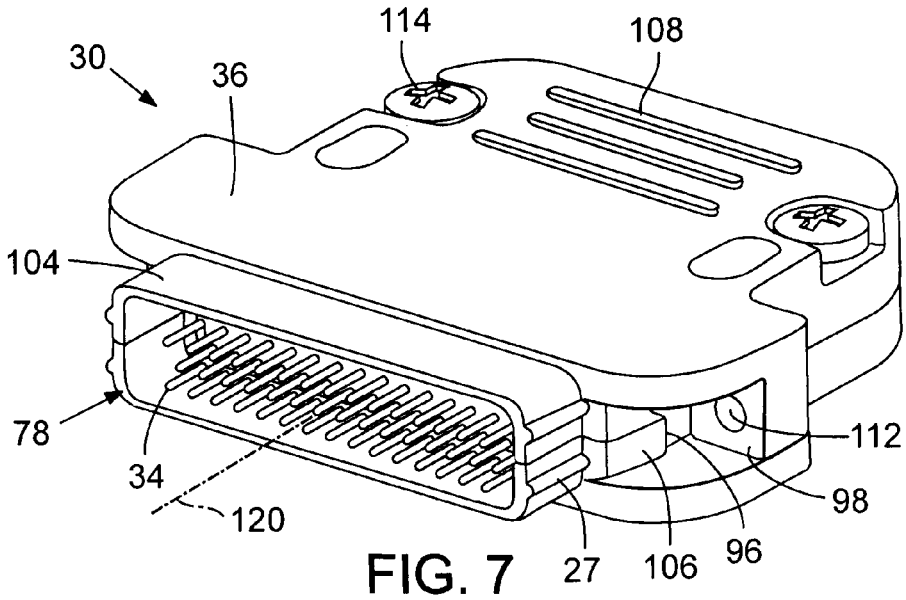
FIG. 7 is a perspective view of the plug connector of FIG. 1.

FIGS. 1-2 illustrate an electrical connector assembly system 10 having a pair of mating connector assemblies 20, 30. For clarity, electrical cables terminated by connector assemblies 20, 30 are omitted from the figures. Socket connector 20 includes a connector body 22 with socket contacts 24 (FIG. 3), and plug connector 30 includes a connector body 32 supporting pin contacts 34 (FIG. 7). Connector bodies 22, 32 are seated in a cavity 64, 74 formed between respective clamshell housing sections 26, 36 of connector assemblies 20, 30. In an assembled configuration, connector bodies 22, 32 and skirts or skirts 100, 104 form a mating end 68, 78 of connector assemblies 20, 30. To mate connector assemblies 20, 30, mating end 68 of connector assembly 20 may be moved along a longitudinal coupling axis 120 to connect with mating end 78 of connector assembly 30 so that pin contacts 34 are inserted into and received by socket contacts 24.

Skirt 100 of socket connector 20 may be divided or sectioned to form a plurality of cantilevered tangs 102 extending around skirt 100. Tangs 102 create numerous contact points and bear against skirt 104 to help retain connector assemblies 20, 30 in a mated configuration. Connector assemblies 20, 30 further include a latch device 80 for positively latching together connector assemblies 20, 30 when in a mated configuration. To decouple connector assemblies 20, 30, latch 82 may be manually depressed and connector assemblies 20, 30 may be pulled apart.

The following describes further detailed aspects of this and other embodiments of the electrical connector assembly 10. It should be understood that certain embodiments may be illustrated or described herein in the context of particular electrical connectors, such as socket and plug connector assemblies, PCB-mounting connectors, D-Sub connectors, or other similar connectors. However, as will become apparent from the following disclosure, the embodiments described herein may be implemented with different kinds of connectors and coupling devices.

FIGS. 3-6 illustrate an embodiment of a socket connector 20 and FIGS. 7-10 illustrate an embodiment of a mating plug connector 30. In some instances, the assemblies 20, 30 may include identical or similar components with respect to one another. The following description may group and describe together any similar components of connector assemblies 20, 30 to avoid repetition. With reference to FIGS. 3-10, connector assemblies 20, 30 each include a separable clamshell housing 26, 36 having an upper housing section 28, 38 and a lower housing section 40, 50. In other embodiments, clamshell housing 26, 36 may include more than two housing sections. For instance, clamshell housing 26, 36 may include a middle portion onto which the upper and lower housing sections may be mounted.

Clamshell housing 26, 36 is preferably an electrically conductive housing that provides EMI shielding (i.e., to inhibit electromagnetic interference) for the components housed therein. In some embodiments, clamshell housing 26, 36 may be die cast or injection molded from a thermoplastic material and plated with a metal material, such as via an electroless nickel plating process, to provide a lighter shell body with desirable EMI shielding properties. In other embodiments, clamshell housing 26, 36 may be made mostly or entirely of metal, such as aluminum. In still other embodiments, clamshell housing 26, 36 may be made of any other suitable material to provide effective EMI shielding.

Clamshell housings 26, 36 each further include an interior seat 42, 52 for receiving and holding a collar 22*a*, 32*a* of connector bodies 22, 32. In addition, clamshell housings 26, 36 may also include channels 43, 53 that are keyed to engage ridges 22*b*, 32*b* to retain connector bodies 22, 32 within clamshell housings 26, 36 and to ensure that connector bodies 22, 32 are correctly installed and face in the proper direction. It should be understood that in other configurations, the location of the keying features (e.g., ridges 22*b*, 32*b* and channels 43, 53) in relation to the connector assemblies 20, 30 may be interchanged without departing from the principles of the disclosure. For instance, the ridges may instead be formed on the clamshell housing and the channels may be formed on the connector bodies.

In some instances, one of the clamshell housings 26, 36 may further include alignment grooves 27 (FIG. 7) on tongue 104 that mate with corresponding channels 29 (FIG. 3) on tongue 100. Alignment grooves 27 and channels 29 are keying features to ensure that connector assemblies 20, 30 are proper mating connectors (e.g., one socket and one plug connector) and that connector assemblies 20, 30 are oriented to avoid damaging one or both of the connector assemblies 20, 30 when mated.

In some embodiments, clamshell housing 26, 36 may include a strain relief 44, 54 formed as an integral part of clamshell housing 26, 36. Strain relief 44, 54 may exit from a rear face 45, 55 of the clamshell housing 26, 36. As illustrated, strain relief 44, 54 may be substantially centered on rear face 45, 55 and aligned with coupling axis 120 to provide a straight exit pathway for a cable or other wiring (not shown). In other embodiments, one or both of strain relief 44, 54 may be an angled strain relief in relation to coupling axis 120, such as having an angle of 30-degrees, 45-degrees, 60-degrees, or another angle to provide an angled exit pathway as desired.

Strain relief 44, 54 may be formed when clamshell housing 26, 36 is joined together to complete connector assembly 20, 30. For instance, upper housing sections 28, 38 each include a pair of concave surfaces 46, 56 and lower housing sections 40, 50 include a second pair of concave surfaces 48, 58. When clamshell housings 26, 36 are joined together, the concave surfaces 46, 48, 56, 58 form strain relief 44, 54. In some embodiments, strain relief 44, 54 includes a cable engaging collar 60, 70 sized to securely engage a cable exiting connector assemblies 20, 30 and prevent wires from being pulled loose from connector bodies 22, 32. Collar 60, 70 may includes a plurality of ridges 62, 72 for biting into the cable to improve cable engagement and strain relief.

The following section describes particular latching and other interconnecting components of electrical connector assembly 10. To provide an easy frame of reference, these components are described as being carried by one of socket connector 20 or plug connector 30. It should be understood that although these particular components may be illustrated and described with respect to one connector assembly and not the other, the location of such components may be interchangeable between the connector assemblies 20, 30 without departing from the principles of the disclosed subject matter.

Figure 3:
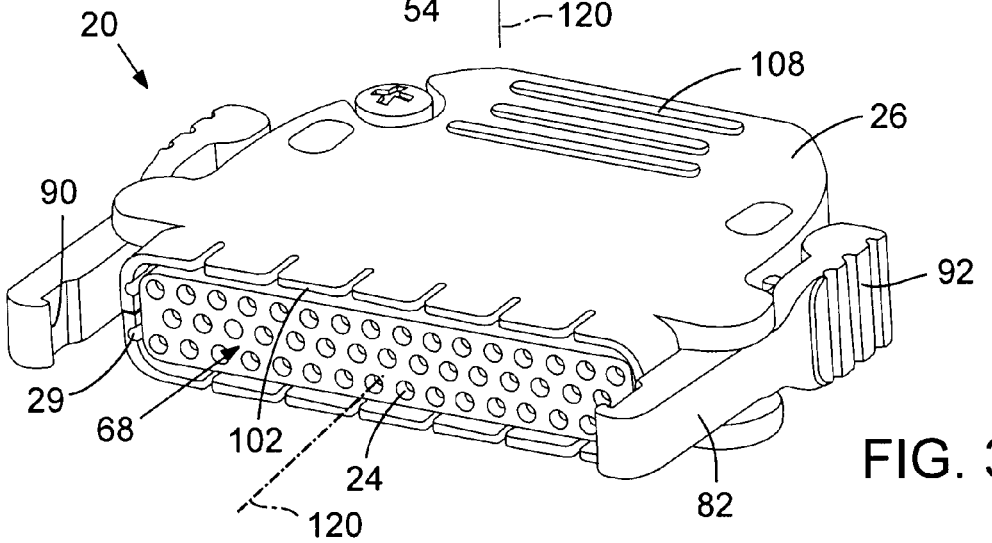
FIG. 3 is a perspective view of the socket connector of FIG. 1.
Figure 4:
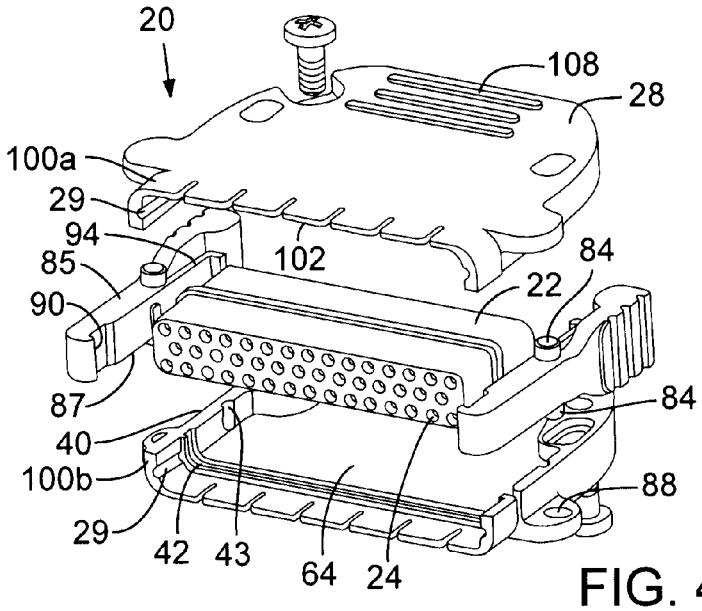
FIG. 4 is an exploded view of the socket connector of FIG. 3.
Figure 5:
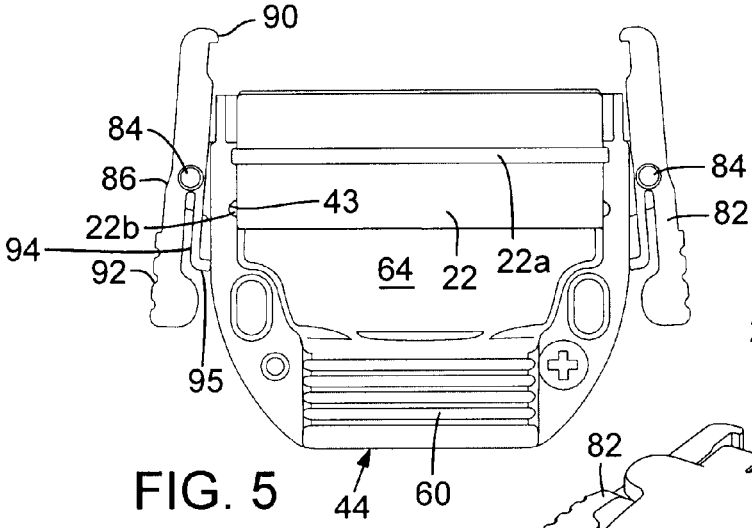
FIG. 5 is a plan view of the socket connector of FIG. 3 with a top housing section removed to show detail of a latch device.
Figure 6:
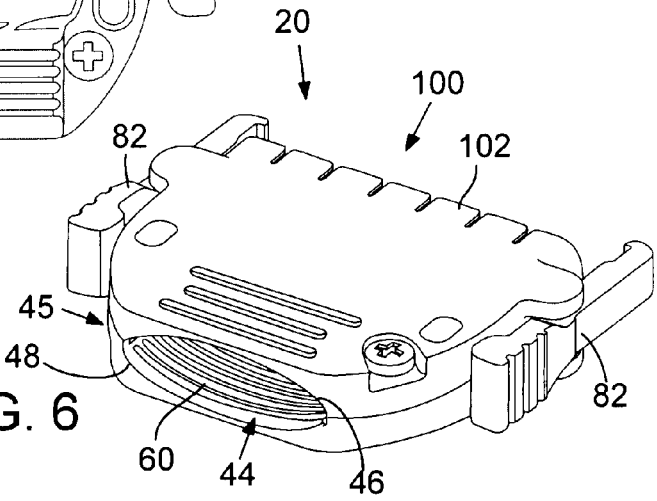
FIG. 6 is a rear perspective view of the socket connector of FIG. 3.

FIGS. 3-6 illustrate further details of socket connector 20 and a latch device 80 for latching together plug and socket connector assemblies 20, 30 when in a mated configuration. With particular reference to FIGS. 4 and 5, latch device 80 includes a pair of latches 82 mounted on opposite sides of upper and lower housing sections 28, 40. When mounted, latches 82 extend substantially parallel to coupling axis 120 and project forwardly in relation to mating end 68 for latching together connector assemblies 20, 30 when in a mated configuration.

Latch 82 includes a pair of bosses 84 each extending from a central base portion 86 and vertically aligned with respect to one another. One boss 84 extends from a top surface 85 and the other boss 84 extends from an opposite bottom surface 87 of base portion 86. Latch 82 further includes a latching end 90 extending generally parallel to coupling axis 120 from base 86. Latching end 90 projects forwardly from mating end 68 of clamshell housing 26. In some embodiments, latching end 90 may include a hook end or recessed surface that cooperates with a corresponding catch 96 of plug connector 30 when connector assemblies 20, 30 are in a mated configuration. Further details relating to the interaction between latching end 90 and catch 96 are described below.

Latch 82 includes a release tab 92 opposite latching end 90. Release tab 90 may be manually depressed to release latch device 80. In some embodiments, release tab 92 may include gripping grooves to provide tactile indication of the location of release tab 92, which may be desirable when latch 82 is located in a blind spot or hard-to-reach area without a clear line-of-sight.

Latch 82 further includes a resilient biasing member 94 for driving latching end 90 toward catch 96 when connector assemblies 20, 30 are in a mated configuration. In some embodiments, resilient biasing member 94 may be a biasing arm that includes a biasing end 95 extending in a transverse direction in relation to coupling axis 120 (i.e., forming a perpendicular or oblique angle with coupling axis 120) and contacting clamshell housing 26 (as shown in FIG. 5). Biasing end 95 bears against clamshell housing 26 and drives latching end 90 toward catch 96 to help retain latch 82 in an engaged connection with catch 96 until disengagement. In other embodiments, resilient biasing member 94 may be a spring or other biasing element configured to drive latch 82 as described.

Preferably, latch 82 is formed from any suitable material, such as plastic or metal that is lightweight to maintain a low overall weight of socket connector 20. In some embodiments, boss 84, latching end 90, release tab 92, and resilient arm 94 are molded as an integral unit of latch 82. In other embodiments, one or more of these components may be formed separately and mounted or adhered to latch 82 using any suitable technique.

In an example assembly process, boss 84 of latch 82 is inserted into corresponding slot 88 formed on opposite sides of clamshell housing 26. Slots 88 pivotably retain latch 82 against clamshell housing 26. As described in further detail below, the pivoting action allows latch 82 to latch and unlatch from corresponding catch 96 of plug connector 30. It should be understood that in other embodiments, the location of boss 84 and slots 88 may be interchanged. For instance, boss 84 may instead protrude from the sides of clamshell housing 26 and slot 86 may be located on latch 82. In still other embodiments, latch 82 may be keyed to clamshell housing 26 using any suitable mating features that may be different than the boss and slot arrangement described.

Figure 9:
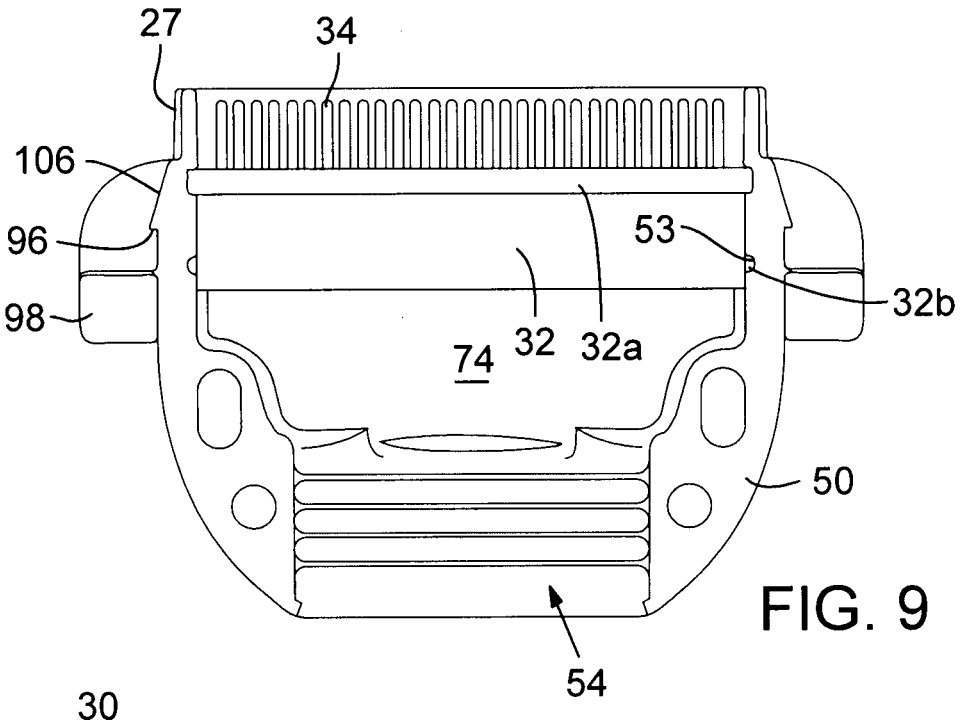
FIG. 9 is a plan view of the plug connector of FIG. 7 with a top housing section removed to show detail of a catch.
Figure 10:
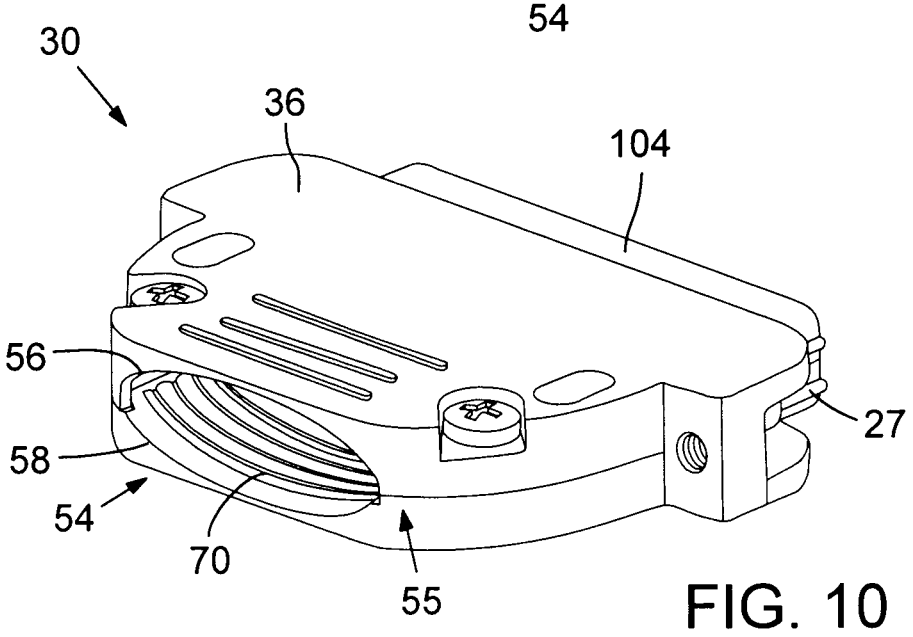
FIG. 10 is a rear perspective view of the plug connector of FIG. 7.

As mentioned previously, latch device 80 engages catch 96 on plug connector 30 when connector assemblies 20, 30 are mated. As best seen in FIG. 9, catch 96 may be formed or molded as part of lower housing section 50 of plug connector 30. Catch 96 may include grooves, ridges, or other catch features to create a complementary surface for retaining latching end 90. Plug connector 30 may include a stop 98 to help guide latching end 90 into catch 96. In addition, plug connector 30 may also include other lead-in or guiding features, such as lateral side walls (not shown) spaced apart from catch 96 and generally perpendicular to stop 98 to facilitate blind mating and engagement of the latching end 90 with catch 96 in dark or hard-to-reach places, for example.

In some embodiments, rather than having socket connector 20 carry both latches 82 and plug connector 30 carry both catches 96, each of socket and plug connector assemblies 20, 30 may carry a catch 96 and a latch 82. In such a configuration, clamshell housings 26, 36 may essentially be mirror images of one another, aside from the different connector bodies 22, 32 on mating ends 68, 78.

Socket connector 20 further includes a skirt 100 formed as an integral part of clamshell housing 26. With particular reference to FIG. 4, upper housing section 28 may include a first skirt section 100*a* and lower housing section 40 may include a second skirt section 100*b*. First and second sections 100*a*, 100*b* may each be generally U-shaped, and when upper and lower housing sections 28, 40 are joined together, form skirt 100. In some embodiments, skirt 100 may be divided into a number of individual sections to create a plurality of cantilevered tangs 102. In some embodiments, tangs 102 may be formed by creating slits on a section of the upper and lower housing sections 28, 40 adjacent mating end 68. Tangs 102 may extend around substantially the entire perimeter of skirt 100. Tangs 102 on upper and lower housing sections 28, 40 may be directly aligned with each other (e.g., as shown in FIGS. 3-4) or may be offset from one another. Tangs 102 may be arranged in other suitable arrangements as desired.

Figure 8:
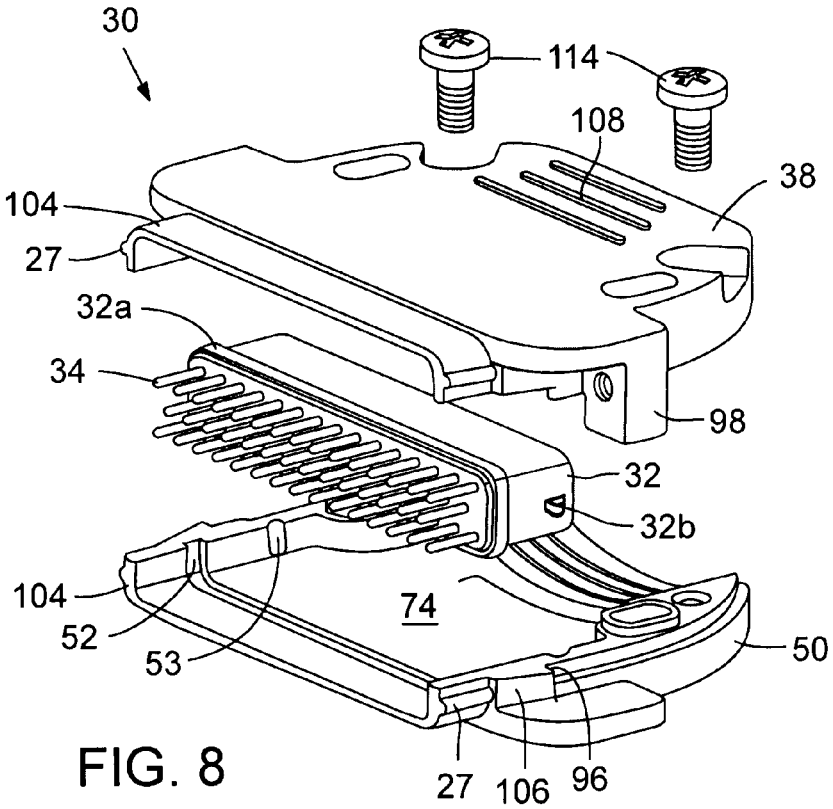
FIG. 8 is an exploded view of the plug connector of FIG. 7.

Similar to socket connector 20, plug connector 30 includes a skirt 104 formed as an integral part of clamshell housing 36. With reference to FIGS. 7-8, upper and lower housing sections 38, 50 may each include a generally U-shaped section that forms skirt 104 when the housing sections 38, 50 are joined together. Preferably, skirt 104 does not include cantilevered tangs, but in some embodiments, skirt 104 may include tangs similar to those of skirt 100. Skirt 104 may be offset from upper and lower housing sections 38, 50 to provide an interference fit between skirt 100, tangs 102, and skirt 104 for maintaining contact between skirts 100, 104. In a mated configuration, skirt 100 and tangs 102 surround skirt 104 as shown in FIG. 1.

Figure 11:
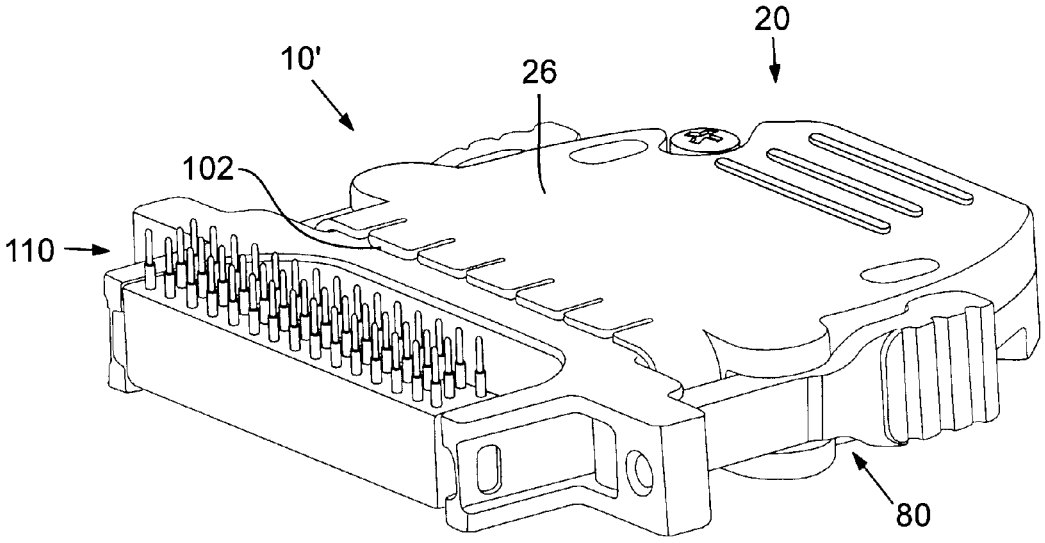
FIG. 11 is a perspective view of an electrical connector assembly with a PCB plug connector according to another embodiment.

FIGS. 1-2 illustrate a mated electrical connector assembly 10 according to one embodiment. FIG. 11 illustrates a second electrical connector assembly 10' for a PCB plug connector 110. Both connectors 10, 10' operate in a like fashion. Accordingly, the following description refers specifically to the electrical connector assembly 10 of FIGS. 1-2, but it should be understood that similar principles apply to connector assembly 10'. With particular reference to FIGS. 1-2, the following description relates to an example assembly for electrical connector 10 with particular details relating to the interaction of the mating components of connector assemblies 20, 30. In an example mating assembly, mating facings 68, 78 of connector assemblies 20, are brought together so that socket contacts 24 of connector body 22 align with and receive pin contacts 34 of connector body 32. Once the contacts 24, 34 are properly aligned, mating ends 68, 78 may be pushed together until latch 82 engages catch 92 to securely retain the mated configuration.

In this mated configuration, skirt 100 of socket connector 20 surrounds skirt 104 of plug connector 30. Tangs 102 of skirt 100 bear against skirt 104 and provide a plurality of continuous contact points to help retain the mated configuration. In addition, since tangs 102 and skirts 100, 104 are each made of material having EMI shielding properties, tangs 102 also help maintain EMI shielding at the junction between mating surfaces 68, 78.

In some embodiments, prior to pushing mating ends 68, 78 together, force may need to be applied to release tab 92 so that latch 82 pivots and opens latching ends 90 outwardly and away from one another. In this configuration, latching ends 90 are moved to a position for engaging catch 90 without interfering with mating end 68 or other components of plug connector 30. In other embodiments, latch 82 may be guided into catch 92 without requiring manual force to pivot latch 82. For instance, as mating ends 68, 78 are brought together to mate connector assemblies 20, 30, latching end 90 may ride against a surface 106 of plug connector 30. Surface 106 may lead or guide latching end 90 toward catch 92 as connector assemblies 20, 30 are brought together. Once latching end 90 engages catch 92, biasing arm 94 springs outwardly away from clamshell housing section 26 and drives latching end 90 into catch 92 to maintain engagement of the two components.

To decouple the mated connector assemblies 20, 30, force may be applied to release tab portion 92 to pivot base 86. As base 86 pivots, biasing arm 94 contracts against clamshell housing 26, which allows latching end 90 to move outwardly and disengage from catch 92. Once the latching end 90 has been disengaged, clamshell housings 26, 36 may be pulled apart to separate skirts 100, 104 and mating ends 68, 78. In some embodiments, clamshell housings 26, 36 may include grip portions 108 to help a user grasp and pull connector assemblies 20, 30 apart. Grip portions 108 may include any number of grasping features, such as ridges, grooves, recesses, or other suitable features.

Although not explained in detail, connector assemblies 20, 30 may include various mounting apertures 112 and mounting screws 114 to retain the assembled clamshell housings 26, 36. In addition, various other mounting apertures 112 may be used to mount connector assemblies 20, 30 on panels or other structures.

It will be obvious to those having skill in the art that many changes may be made to the details of the above-described embodiments without departing from the underlying principles of the invention. The scope of the present invention should, therefore, be determined only by the following claims.

The invention claimed is:

1. An electrical connector comprising:

an electrically conductive housing for inhibiting electromagnetic interference, the housing having an upper and lower housing section with a cavity disposed therebetween, and further including a mating end on a front face of the housing;

a connector body seated in the cavity of the housing, the connector body having a plurality of contacts extending in an axial direction along a coupling axis;

a latch device mounted to the housing and having at least one latch arm, the latch arm further comprising:

a base rotatably mounted to the housing; and a latching end extending from the base and projecting forwardly from the mating end of the housing along a generally parallel axis to the coupling axis, the latching end configured to engage a corresponding catch of a mating connector;

a biasing member in communication with the latch device, the biasing member extending in a transverse direction in relation to the coupling axis and contacting the housing for driving the latching end toward the catch to maintain engagement with the catch; and a skirt on the mating end of the housing, the skirt having a plurality of cantilevered tangs for bearing against a corresponding mating end of the mating connector.

2. The electrical connector of claim 1, further comprising a pair of slots formed on opposite sides of the housing, and a pair of coaxially aligned bosses formed on the latch arm for mounting the latch arm into the slots.

3. The electrical connector of claim 1, wherein each of the upper and lower housing sections further comprising a concave surface, wherein when the upper and lower housing sections are joined, the concave surfaces form a strain relief having an exit opening on a rear face of the clamshell housing opposite the front face.

4. The electrical connector of claim 3, wherein the strain relief further includes a collar having a plurality of ridges.

5. The electrical connector of claim 1, wherein the base, latching end, and biasing member are formed as a single, integral part of the latch arm.

6. The electrical connector of claim 1, wherein each of the upper and lower housing sections include a U-shaped half of the skirt, and wherein the skirt is formed when the upper and lower housing sections are joined.

7. The electrical connector of claim 1, wherein the skirt is offset from a top and bottom surface of the clamshell housing.

8. The electrical connector of claim 1, wherein the electrically conductive housing comprises a plastic material with electroless nickel plating.

9. An electrical connector assembly comprising:

a first connector comprising:

a first electrically conductive housing for inhibiting electromagnetic interference, the first housing having a first upper and lower housing section with a first cavity disposed therebetween, and further including a first mating end on a first front face of the housing;

a first connector body seated in the first cavity of the first housing, the first connector having a first plurality of contacts extending in an axial direction along a coupling axis;

a latch device mounted to the first housing and having at least one latch arm, the latch arm having a latching end extending from a base portion and projecting forwardly from the first mating end of the housing along a generally parallel axis to the coupling axis; and a first skirt on the first mating end of the first housing, the first skirt having a plurality of cantilevered tangs extending around a perimeter of the first skirt; and a second connector configured to mate with the first connector, the second connector comprising:

a second electrically conductive housing for inhibiting electromagnetic interference, the second housing having a second upper and lower housing section with a second cavity disposed therebetween, and further including a second mating end on a second front face of the housing;

a second connector body seated in the second cavity of the second housing, the second connector having a second plurality of contacts extending in an axial direction along a coupling axis and configured to mate with the first plurality of contacts;

a catch formed as an integral part of the second housing; and a second skirt on the second mating end of the second housing, the second skirt offset from a top and bottom surface of the second housing;

wherein when the first and second connectors are mated, the latching end engages the catch to retain the first and second connectors in a mated configuration, and the first skirt surrounds the second skirt so that the cantilevered tangs of the first skirt bear into the second skirt for retaining the first and second connectors in a mated configuration.

10. The electrical assembly of claim 9, wherein the housing of the second connector further includes a lead-in surface for guiding the latching end into the catch.

11. The electrical assembly of claim 10, wherein the housing of the second connector further includes a stop adjacent the catch for guiding the latching end into the catch.

12. The electrical assembly of claim 9, wherein the latch device further comprises a biasing arm extending in a transverse direction in relation to the coupling axis and contacting the housing for driving the latching end toward the catch to maintain engagement with the catch.

* * * * *